US005393060A

United States Patent [19]

Land et al.

[11] Patent Number: 5,393,060

[45] Date of Patent: * Feb. 28, 1995

[54] GAME PIECE RANDOMIZER

[76] Inventors: Larry D. Land; Marie A. Land; Melissa L. Land, all of 1946 Edgerton, St. Paul, Minn. 55117

[ * ] Notice: The portion of the term of this patent subsequent to Mar. 30, 2010 has been disclaimed.

[21] Appl. No.: 38,603

[22] Filed: Mar. 29, 1993

Related U.S. Application Data

[63] Continuation of Ser. No. 715,844, Jun. 14, 1991, Pat. No. 5,197,735, which is a continuation-in-part of Ser. No. 477,551, Feb. 9, 1990, abandoned.

[51] Int. Cl.[6] ..... A63F 9/04

[52] U.S. Cl. ..... 273/138 R; 273/145 C; 273/450

[58] Field of Search ..... 273/145 R, 145 A, 145 B, 273/145 C, 145 CA, 145 D, 144 R, 144 A, 145 D, 145 E, 120 R, 136 R, 138 R, 440, 450, 459, 243

[56] References Cited

U.S. PATENT DOCUMENTS

| | | | |
|---|---|---|---|
| 772,281 | 10/1904 | Jurado | 273/120 R |
| 2,102,807 | 12/1937 | Yerks | 273/138 R |
| 2,742,291 | 4/1956 | Simon | 273/120 R X |
| 3,084,478 | 4/1963 | Burger | 273/144 R |
| 3,578,320 | 5/1971 | Goldfarb | 273/459 |
| 3,610,628 | 10/1971 | Promin | 273/120 R X |
| 3,655,191 | 4/1972 | Grant | 273/459 X |
| 4,757,999 | 7/1988 | Opresco | 273/138 R X |
| 5,197,735 | 3/1993 | Land | 273/450 X |

FOREIGN PATENT DOCUMENTS

| | | | |
|---|---|---|---|
| 1267316 | 3/1972 | United Kingdom | 273/145 CA |

*Primary Examiner*—Sebastiano Passaniti
*Attorney, Agent, or Firm*—Douglas L. Tschida

[57] ABSTRACT

Apparatus for randomly manipulating and distributing one or a plurality of game pieces such as dice, marbles, coins or the like. In one construction, the game piece is contained within a closed housing having a plurality of apertures formed through side and end walls to support selectively positioned obstruction pieces which may be positioned by the players in a random or predetermined pattern to provide a plurality of passageways through which the game pieces must pass. In another construction, an open ended housing includes a game piece receiving portion, a player selectable directing portion and a randomizer portion including a plurality of obstruction pieces. In another construction, one or more coins may be semi-permanently contained within the housing. In still other constructions, the housing is constructed in halves, each of which contain integral obstruction pieces which define a plurality of passageways to a plurality of permanently contained game pieces.

17 Claims, 12 Drawing Sheets

GAME PIECE RANDOMIZER

PRIOR APPLICATIONS

This is a continuation of application Ser. No. 07/715,844, filed Jul. 14, 1991, now U.S. Pat. No. 5,197,735, which is a continuation-in-part of application Ser. No. 07/477,551, filed Feb. 9, 1990, abandoned.

BACKGROUND OF THE INVENTION

The present invention relates to game piece manipulators and in particular to a user programmable randomizer.

Varieties of board games and games of chance are focused upon randomly manipulated game pieces, such as the spinning of a spinner relative to a numbered wheel, the throwing of dice or the manipulation of a marble relative to a valued game board compartment, as in roulette. Scoring, in turn, is determined in relation to the randomly manipulated game piece.

Applicant is aware that random movement of some game pieces can be facilitated with a mechanical appliance, such as with a dice cup or a rotatable dice cage. Devices of this type most typically contain the game piece within a housing having a generally unobstructed interior. Examples of some of such structures can be found in U.S. Pat. Nos. 3,360,267; 4,383,689; 4,826,170; 4,807,883; 4,805,908; 4,428,579; and 4,428,580. Movement of the surrounding housing determines the movement of the game piece.

Pinball machines and the like also depend upon a randomly manipulated game piece, although include obstructions which are rigidly secured to one surface of a game board to randomly direct the game piece, upon striking same. Ones of such games also include ledges positioned about the game board surface for catching the game piece. Such assemblies, however, provide for a fixed gameboard structure which does not permit user intervention relative to the positioning of the obstructions.

Appreciating, however, the greater variables of randomness which are introduceable by way of manipulators which permit user intervention and the further desirability of a holder for containing the game pieces, Applicant has developed a variety of constructions of randomizers which facilitate the foregoing ends.

SUMMARY OF THE INVENTION

It is accordingly a primary object of the present invention to provide a randomizer for confining one or more game pieces to a housing including obstruction pieces which are selectively mountable in the housing.

It is a further object of the invention to provide a housing including means for permitting arbitrary user placement of one or a plurality of the obstruction pieces.

It is a further object of the invention to provide housings of different configurations to accommodate varieties of game and obstruction pieces.

In variously described constructions of the invention, enclosed tubular and cubic housings provide a plurality of through apertures formed in the side and housing end walls to matingly receive obstruction pieces mounted within one or more of the apertures. The obstruction pieces extend partially or completely between opposite wall surfaces of the housing. One or more game pieces contained within the housings encounter the user positioned obstruction piecess, much in the fashion of an obstacle course, upon manipulating the housings within a predetermined play pattern, for example alternately inverting and re-inverting the housing.

In another construction of the invention, a housing provides open upper and lower ends and intermediate of which are provided aperture containing sections wherethrough obstruction pieces are positionable in predetermined and/or random patterns. A game piece directing section of the housing otherwise includes a plurality of pseudo-randomly positioned apertures, wherethrough players can position or not other obstruction pieces. The game piece otherwise is admitted at a receiver section and exits through partitioned windows in the housing to a bottom tray, once the game piece has traversed the obstruction pieces.

The foregoing objects, advantages and distinctions of the invention, among others, as well as the details of the variously considered constructions will become more apparent hereinafter upon reference to the following description with respect to the appended drawings. Before referring thereto, it is to be appreciated the following description is made by way only of variously considered and presently preferred constructions. Such constructions should not be interpreted in limitation of the invention, but should be interpreted to encompass all those constructions contemplated by the following claims.

DESCRIPTION OF THE PREFERRED EMBODIMENT

Figure 1:
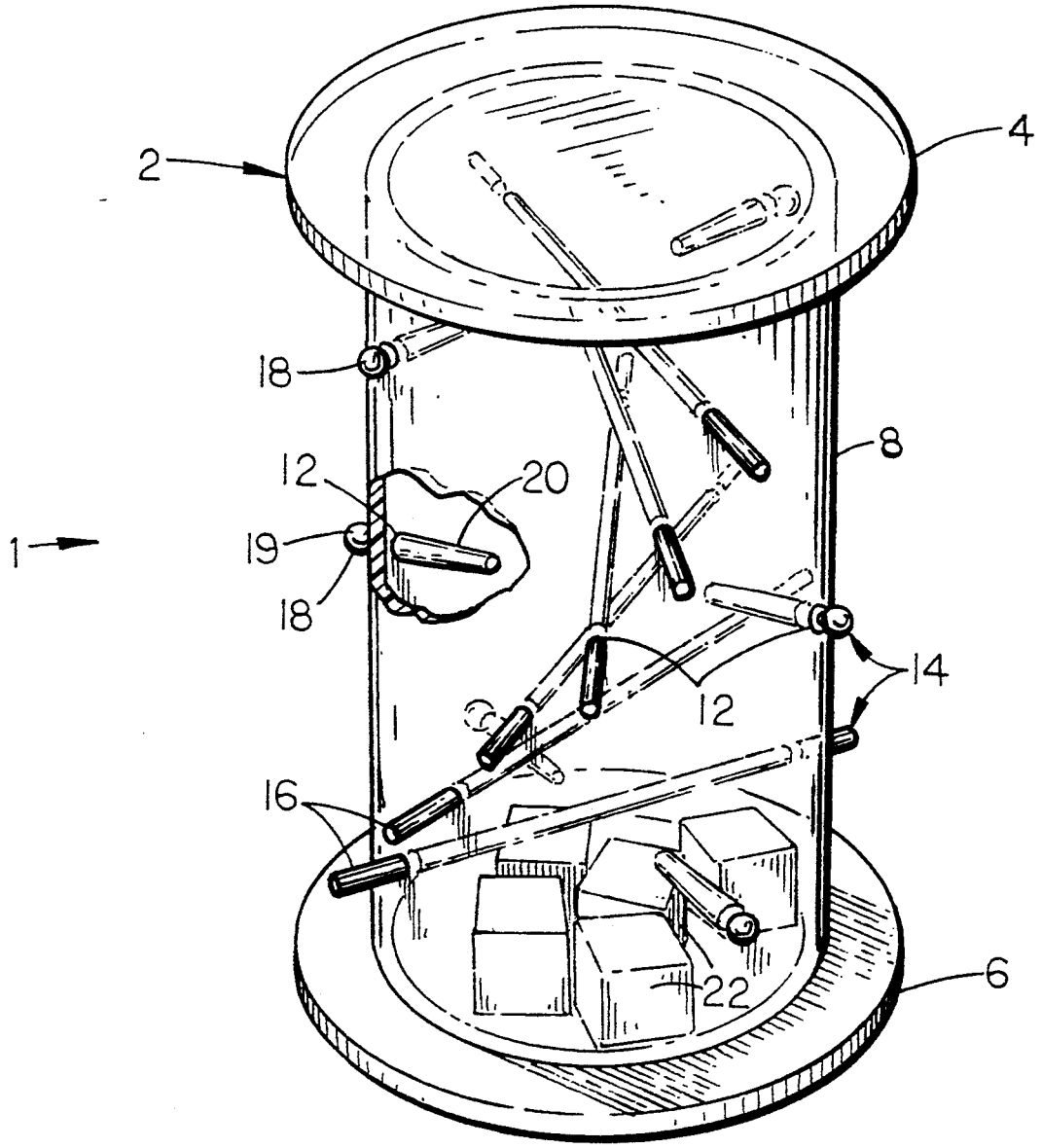
FIG. 1 shows an isometric drawing of a closed tubular, dice containing housing.

Referring to FIG. 1, an isometric drawing is shown of a game piece randomizer 1 having a tubular housing 2 including upper and lower, circularly flat endplates 4 and 6 which are bonded to a tubular mid-portion 8. As presently constructed, the housing 2 is formed of clear, acrylic materials, which through the selective use of various adhesion systems, permit the bonding of the walled portions 4, 6 and 8 of the housing to each other to form the depicted housing 2.

Figure 2:
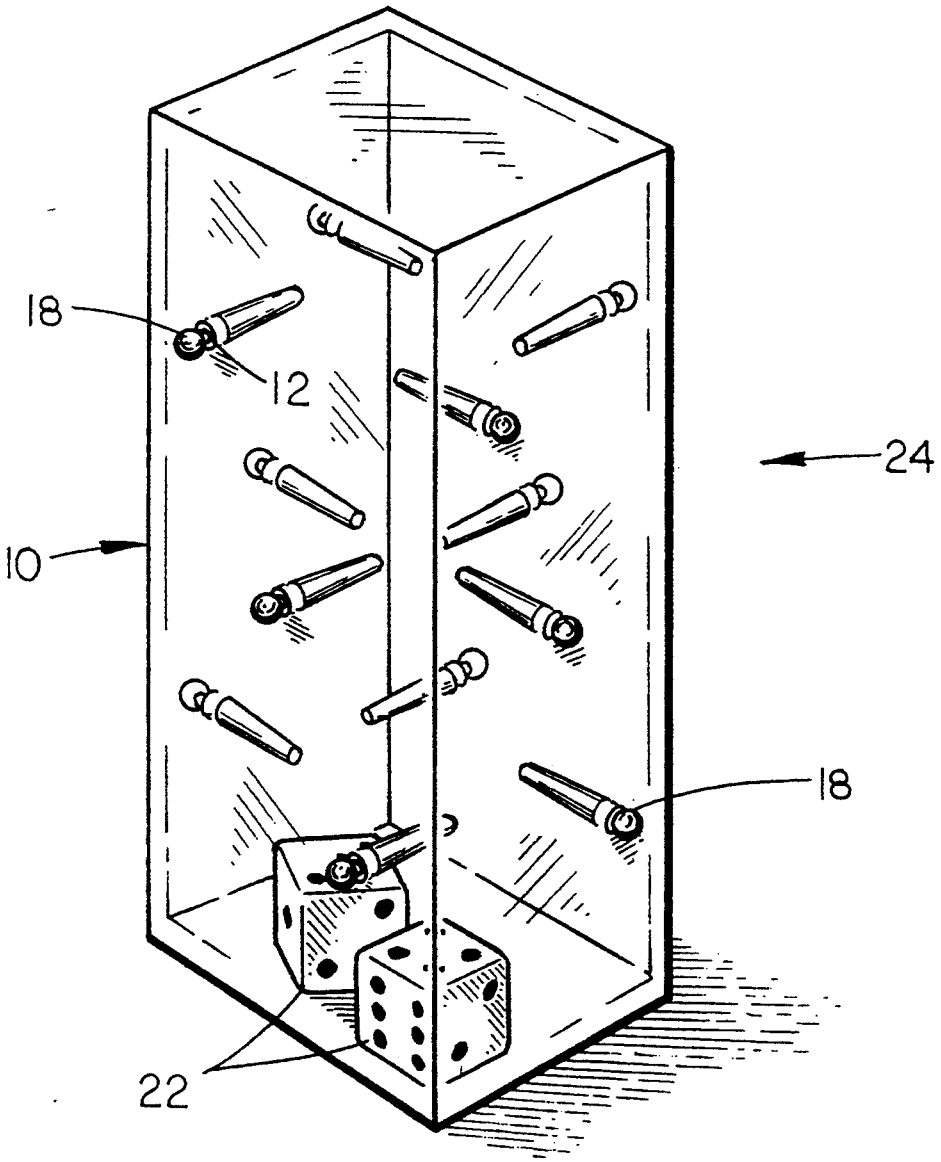
FIG. 2 shows an isometric drawing of a closed, rectangular or flat walled housing for shaking dice.

Although FIG. 1 shows a tubularly constructed housing and FIG. 2 depicts a rectangular housing 10, it is to be appreciated that still other multi-sided enclosed housing constructions can be formed, such as cubes, spheres, octagons or the like. The specific shape merely being a matter of manufacturer preference and/or imagination. The more elaborate the configuration, however, the greater the labor requirements to fit and bond the walls to one another.

Provided along the length of the tubular wall 8 are a plurality of through apertures 12 and wherein individual obstruction pieces 14 are mountable. These apertures may either be randomly distributed or may align with selected other apertures formed in opposite or adjacent walls. As depicted in FIG. 1, the apertures are formed through opposite sides of the tubular wall 8 to provide a spiral-ladder work, upon inserting full length obstruction pieces 16 through the aligning apertures in the opposite side walls. That is, the obstruction pieces 16 comprise enlongated rods of a diameter comparable to the apertures which extend completely through the housing 2.

In contrast, the obstruction pieces 18, only partially extend into the interior of the housing 2. A ball-like head 19 and tapered body 20 are provided on the pieces 18 to facilitate insertion. Thus, a player has a great deal of selectivity in the creation of the alternative paths the game pieces can traverse. For the assembly 1, the game pieces comprise a plurality of permanently contained dice 22.

In contrast to FIG. 1, the assembly 24 of FIG. 2 discloses a construction wherein the obstruction pieces 18 extend only partially into the interior of the housing 10 from each of the side walls. These obstruction pieces 18, as mentioned, include a shaped end 19 and tapered body 20. As with the assembly 1, the obstruction pieces 18 are mountable at the user's discretion. The amount of jostling which the game pieces (i.e. dice 22) undergo as they fall within either of the housings 2 or 10, upon rotating same, and the pathways taken will depend upon the placement of the obstruction pieces 18.

Relative to obstruction piece placement, the principle concern is that too many obstruction pieces 14 not be used or else movement of the game pieces can become unduly hampered. Instead of performing the desired function of providing a random movement of each game piece, one or more game pieces can become lodged amongst the obstruction pieces 14. Appreciating also that the movement of the game pieces could become semi-predictable for a patterned positioning of the obstruction pieces 14, the present housings 2 and 10 allow players to change same over the course of time to provide different game piece actions and random pathways. Alternatively, however, the obstruction pieces 14 could be permanently bonded to the housings 2 and 10 by suitable adhesives or integrally formed therewith (reference FIGS. 5*a*, 5*b*, 5*c* and 6).

In contrast to pinball machines and the like, it is to be appreciated the present obstruction pieces 14 merely cause a careening action which is of no consequence other than randomizing the game piece fall relative to all available pathways. It is only, the ultimate positioning of the game piece upon falling through a created random obstacle course, comprised of a plurality of the obstruction pieces 14, that determines the play event.

With the foregoing in mind, it is to be appreciated that still other closed or open housing constructions of various shapes and sizes can also be constructed. Such housings, as with the enclosed housings 2 and 10, can use dice or a variety of other game pieces, such as coins or marbles, reference FIGS. 3, 4, 5*a*–5*c* and 6. Mechanical actuators may also be included to facilitate manipulation of the game pieces relative to the obstruction pieces, reference FIGS. 9 and 10.

Figure 3:
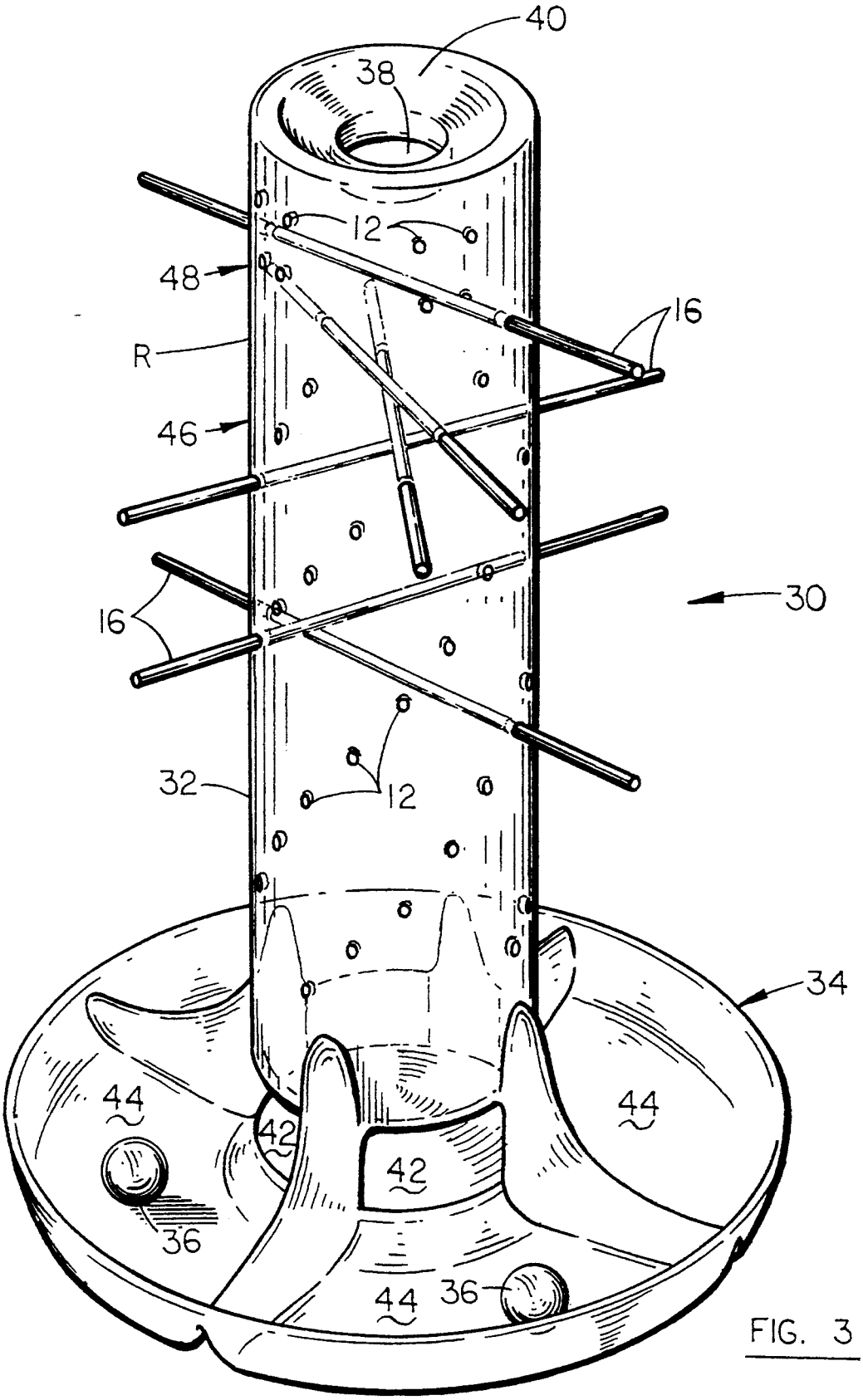
FIG. 3 shows an isometric drawing of an open-ended, cylindrical randomizer which provides for a player selectable section and a pre-patterned obstruction piece containing section, intermediate a game piece receiver and partitioned scoring compartment

In the latter regard, attention is directed to FIG. 3 wherein an assembly 30 is shown that provides a tubular housing 32 having a partitioned, saucer like tray bottom 34. The tray receives a plurality of marbles 36, upon dropping a number of marble game pieces through a receiver aperture 38 at the top of the housing 32. The receiver section of the housing 32 also includes a funnel-like forward section 40 which pre-directs the marbles and which is desirable if a number of marbles are placed in play simultaneously. As they progress through the housing 32, the marbles strike the obstruction pieces 16 and ultimately are randomly deflected to exit via one of a plurality of openings 42 within the housing sidewalls, to one of a number of co-aligned tray partitions 44.

In contrast to the assemblies 1 and 24 of FIGS. 1 and 2, the assembly 30 of FIG. 3 provides for an obstacle path which includes a patterned obstruction portion 46 lying beneath a reference line R and a player directing portion 48 lying above the reference line R. That is, the apertures 12 of the lower patterned portion 46 provide adjacent columns of obstruction pieces 16 which are mounted in spiral ladder fashion to each other. The apertures of upper portion 48 otherwise are randomly positioned, such that a player can mount one or more of a number of obstruction pieces 16 to vary or pre-direct the initial fall of the marble or marbles, before striking the lower patterned portion 48. Thus, where a player may become accustomed to the peculiarities of fall of a predetermined lower portion 48, the upper portion can be tailored to vary the fall, by merely repositioning one or more of the obstruction pieces 16.

Figure 4:
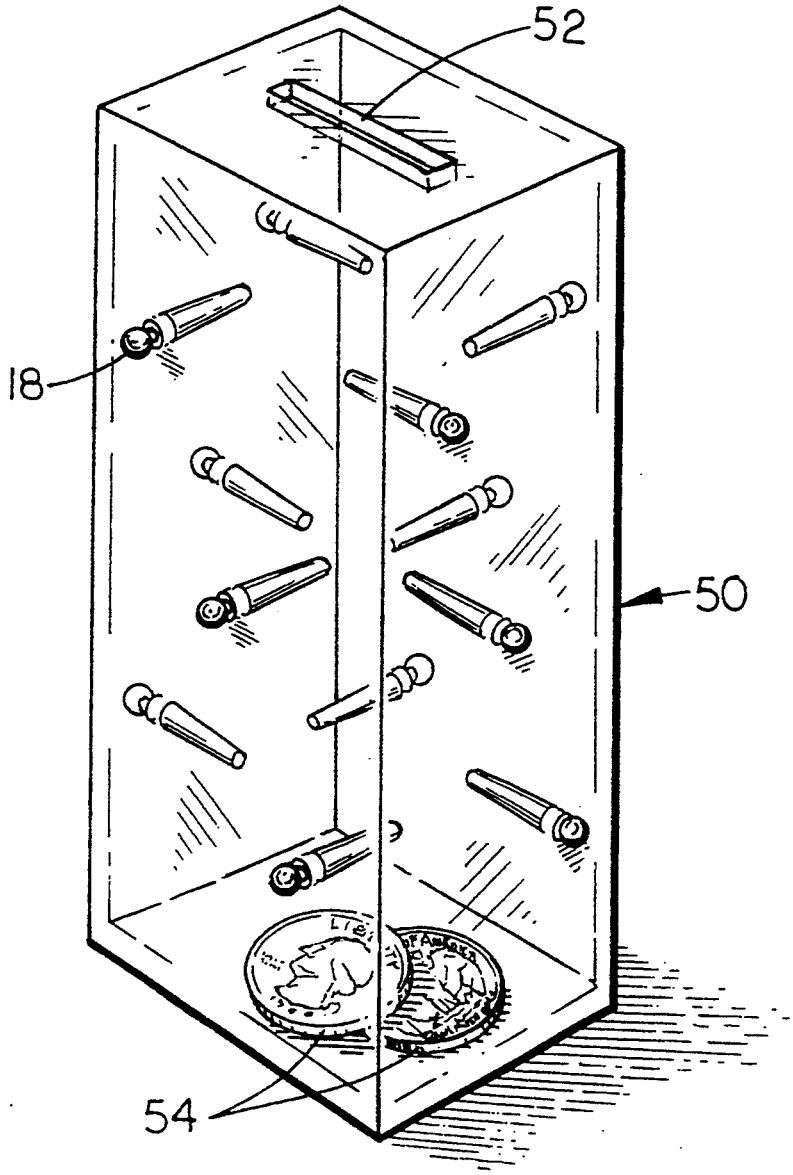
FIG. 4 shows an isometric drawing of a coin randomizer.

Attention is also directed to FIG. 4, and wherein an isometric drawing is shown of a housing 50 including obstruction pieces 18 and a slot 52 formed in one end to receive one or more coins 54. For this embodiment and although the coins 54 can be removed, normally they are allowed to remain in the housing 50. Upon rotating the housing 50, different permutations of heads/tails are obtainable once the coins have randomly traversed the randomly positioned obstruction pieces 18.

Figure 5A:
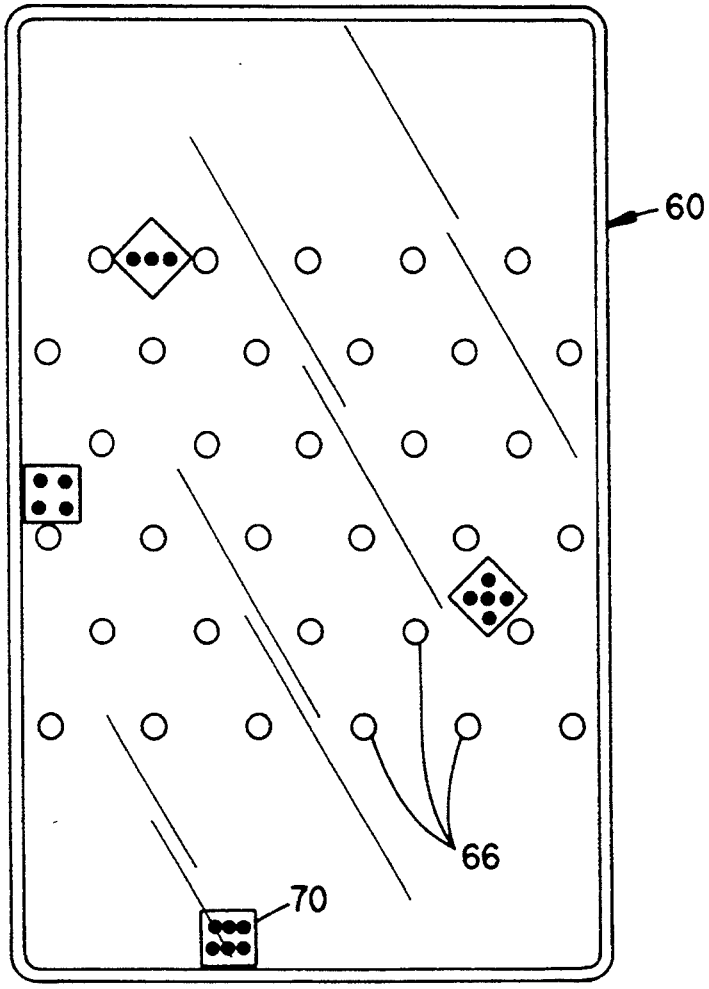
FIGS. 5*a*, 5*b* and 5*c* show respective front and side elevation drawings and a top plan drawing of a rectangular walled housing which is configured in two halves and includes a plurality of obstruction pieces which extend from the walls of the halves.
Figure 5B:
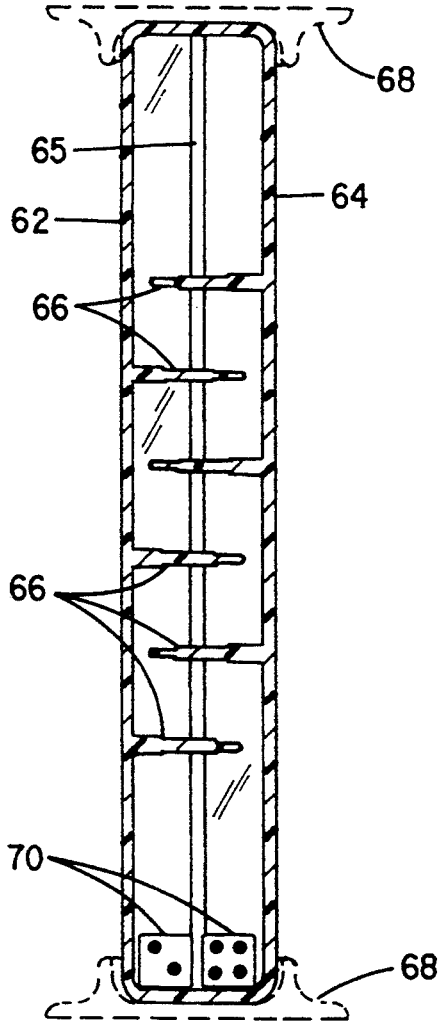
Figure 5C:
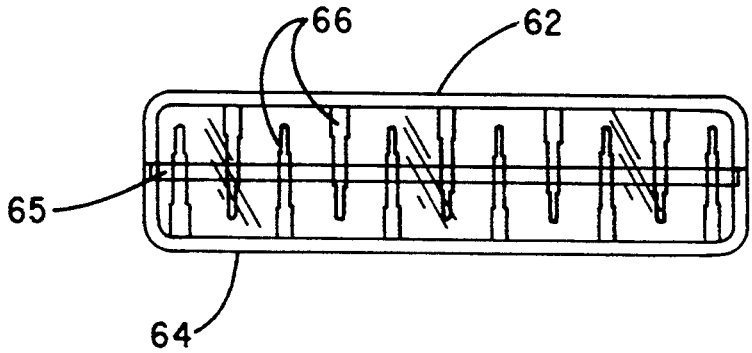

With attention to FIGS. 5*a*, 5*b* and 5*c*, respective front and side elevation drawings and a top plan drawing are shown of a rectangular walled randomizer 60 which is configured from two open-ended shells or halves 62 and 64. The halves 62, 64 include peripheral edges at the open ends which mount to each other and form a seam 65. Each of the halves 62, 64 includes a plurality of obstruction pieces 66 which are integrally formed with and project from the walls of the halves 62, 64. Shown in dashed line are end caps 68 which retain the halves together and serve as support stands for the randomizer 60. Alternatively, the halves 62, 64 can be adhesively bonded to one another; the peripheral edges may also be formed to permanently or semi-permanently interlock and formed a sealed seam. In such a circumstance the edges or halves 62, 64 may include overlapping, flanged surfaces which snap mount to one another. Mounted within the randomizer 60 are a number of indicia containing dice 70.

Figure 6:
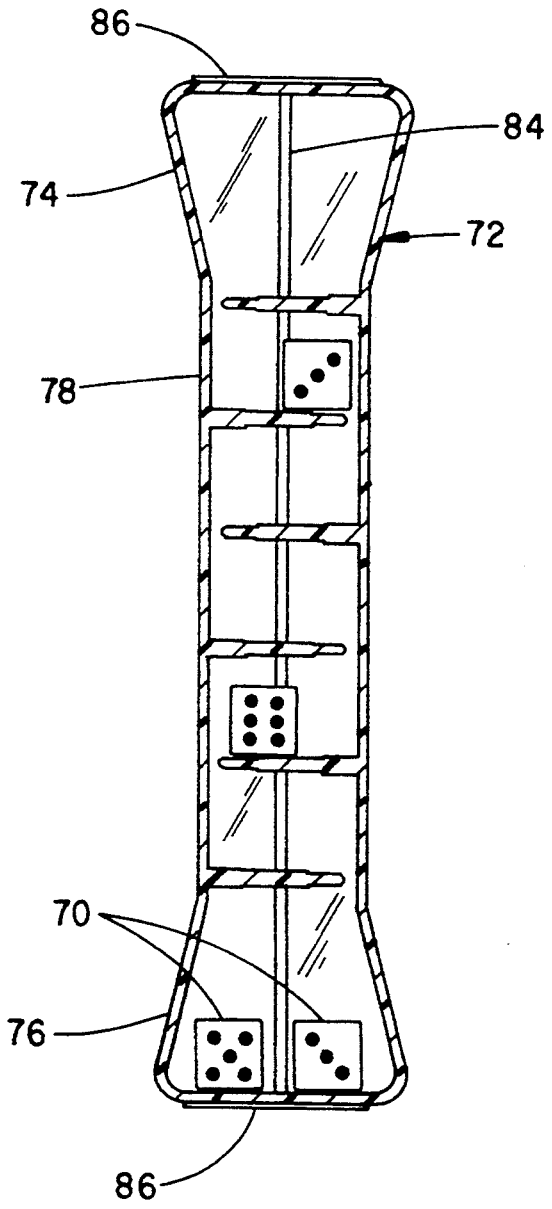
FIG. 6 is a side elevation drawing of a housing similar to that of FIGS. 5*a*, 5*b* and 5*c* wherein the ends are broadened to serve as support stands.

FIG. 6 depicts a randomizer 72 which is configured sustantially similar to the randomizer 60, except the top and bottom ends 74 and 76 of the housing 78 are expanded to serve as table supports. The halves 80 and 82 of the housing 78 mount to one another along a seam 84 end, snap-lock retainers 86 which secure the halves 82, 84 to contain the dice 70. The obstruction pieces 14 extend in rows and are alternately, laterally offset from row to row to provide multiple pathways to the fall of the dice 70.

Figure 7:
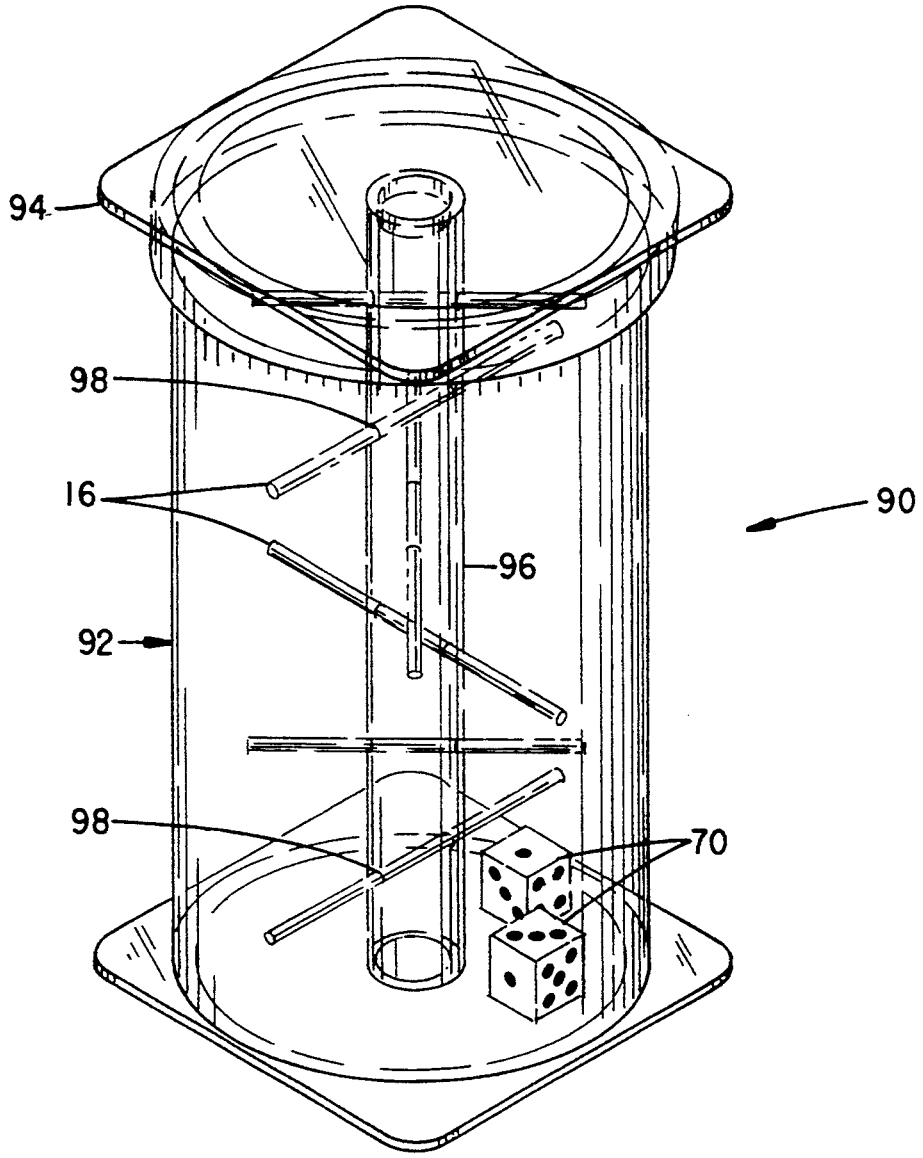
FIG. 7 is a perspective drawing of a randomizer having a removeable end cap and core which contains obstruction pieces.
Figure 8:
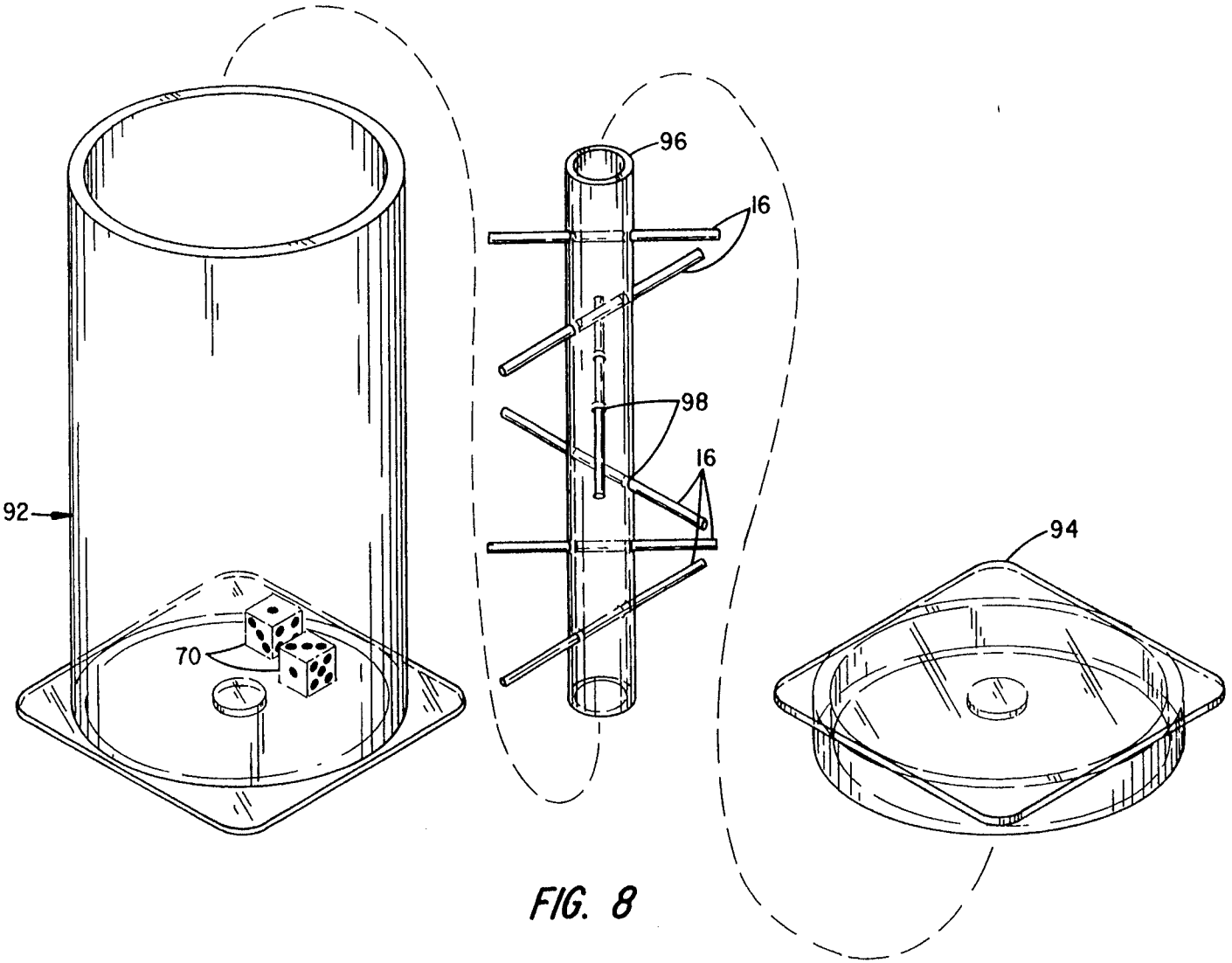
FIG. 8 is an exploded assembly drawing of FIG. 7.

FIGS. 7 and 8 disclose yet another randomizer 90 which is constructed to provide a housing 92 having a removable end cap 94. Contained within the housing 92 between the interior surfaces of the end cap 94 and the bottom is a core 96 which contains a plurality of obstruction pieces 16 mounted within apertures 98 let into the core 96. It is to be appreciated that other obstruction pieces 14 could also be mounted to extend from the outer periphery into the interior of the housing 92 in the fashion of the assemblies 2 and 10. A randomly defined free fall column is thereby presented to the contained dice 70 or other gamepieces.

Figure 9:
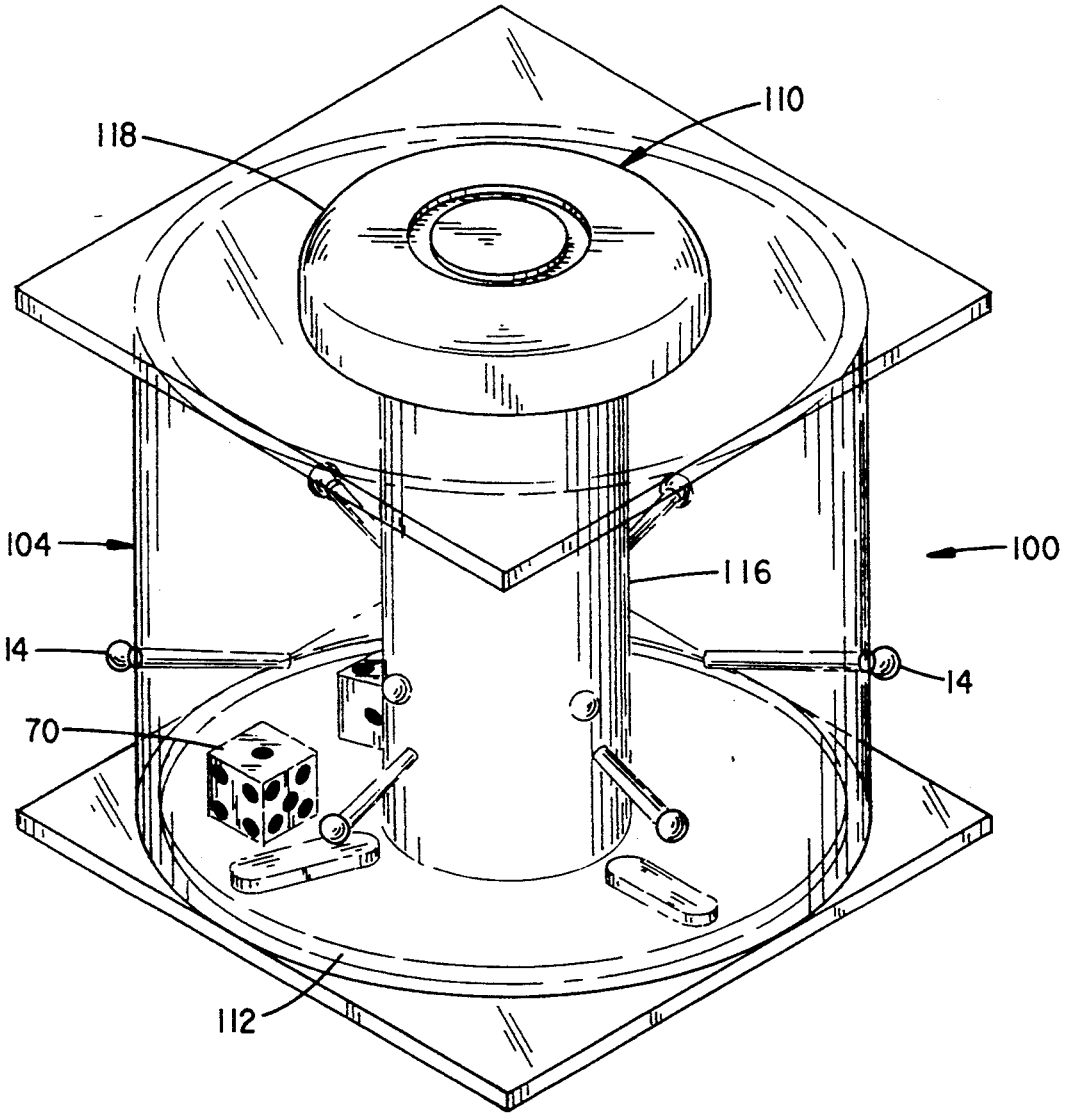
FIG. 9 is a perspective drawing of a randomizer containing a hand rotated actuator for inducing game piece movement relative to the obstruction pieces.
Figure 10:
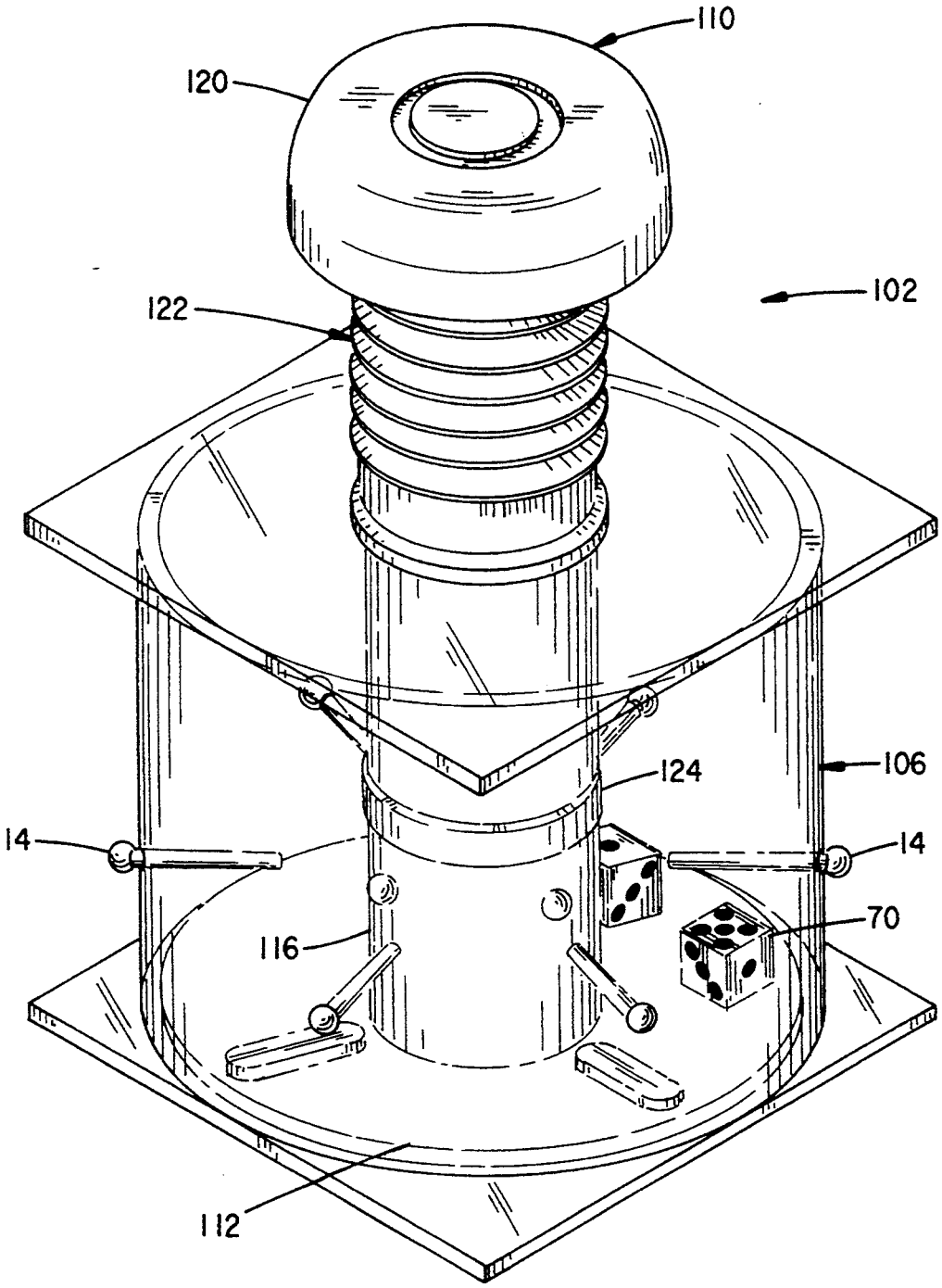
FIG. 10 is a perspective drawing of a randomizer containing a spring biased actuator.

FIGS. 9 and 10 disclose still other randomizers 100 and 102 which respectively provide housings 104 and 106 which support player mounted obstruction pieces 14. Although partially extending obstruction pieces 18 are particularly shown, the pieces can also comprise full extension pieces 16. Multiple dice 70 are supported within the housings 104 and 106 at game piece actuators 108 and 110. Each actuator 108, 110 contains a wheel or disc 112 which supports a plurality of radially disposed projections 114. The wheel 112 is mounted to pivot about a spindle (not shown). An axle 116 projects from the wheel 112.

For the randomizer 100 the axle 116 extends through the end wall to mate with a hand cap 118 which lends itself to rotation by the player. The player is able to spin the cap 118 and thereby rotate wheel 112 to induce movement of the game pieces 70, which are engaged by the projections 114, to strike the obstruction pieces 14. A free fall column of sorts is thus obtained which depends only upon the duration the spinning is maintained.

Rotation of the wheel 112 at the randomizer 102 is obtained with a hand cap 120. The cap 120 includes a spring clutch portion 122 which couples to an axle portion 124 that mates with the axle 116. Upon depression of the cap 120, an internal coupler connection (not shown) induces rotation of the axle 116 and wheel 112 and consequent movement of the dice 70. Presently, the coupler comprises a depressible rod having a spiral twist region. The rod mates with a mating slot at the axle 116 such that vertical movement of the rod is translated into rotational movement at the wheel 112, as the wheel 112 follows the twist in the rod. Projecting surfaces (shown in dashed line) may be included at the wheel 112 to segment the exposed surface into scoring regions. Such projections may also facilitate movement of the game piece 70.

While the present invention has been described with respect to various presently considered and preferred constructions, it is to be appreciated that still other constructions may suggest themselves to those of skill in the art. These, again, may constitute assemblies with permanently configured game piece pathways or assemblies having obstruction piece containing pathways under partial or complete player control, depending upon the rules of play. Accordingly, it is contemplated that the following claims should be interpreted to include all those equivalent embodiments within the spirit and scope thereof.

What is claimed is:

1. Game apparatus comprising:

a) a game piece;

b) a multi-walled, air filled housing, wherein the walls mount to one another to completely enclose and contain said game piece and to define a columnar play space between ones of the plurality of walls where movement of said game piece is restricted, wherein said housing is comprised of first and second open-ended shells, wherein peripheral edges of said first and second shells mate to one another, and wherein said housing includes means for retaining said first and second shells to one another;

c) a plurality of obstruction members mounted to project from ones of said walls into the play space to form a plurality of alternate pathways to said game piece at interstices between the obstruction members, wherein none of said obstruction members contact any other obstruction member, wherein each obstruction member is shaped in the form of a rod and mounted to deflect said game piece upon contact, and wherein the obstruction members are arranged to randomly deflect the game piece without interrupting movement of the game piece within the play space or permitting passage of the game piece between a distal end of any obstruction member and an adjacent wall and to cause the game piece to randomly follow one of the alternate pathways as the game piece traverses the play space prior to coming to rest on one of the walls.

2. Apparatus as set forth in claim 1 wherein said obstruction members are integrally formed with said first and second shells.

3. Apparatus as set forth in claim 1 including holder means which mount to said housing for supporting said housing between play.

4. Apparatus as set forth in claim 1 wherein ones of said walls are rectangular.

5. Apparatus as set forth in claim 1 wherein first and second opposite end walls of said housing are flat, wherein each of first and second vertical walls, which extend between said first and second end walls, include surfaces adjacent the first and second end walls which bow outward from an intermediate planar region, and wherein the intermediate planar regions of each of said first and second vertical walls are mounted parallel to one another.

6. Apparatus as set forth in claim 1 including an aperture through one of said walls for selectively admitting said game piece to said housing and wherein the aperture is positioned to prevent the escape of the game piece during normal play.

7. Apparatus as set forth in claim 1 wherein none of said obstruction members contact any other obstruction member and wherein each obstruction member projects without contacting any other of said plurality of walls.

8. Apparatus as set forth in claim 1 wherein said game piece has a plurality of surfaces and each surface contains a scoring indicia and including means having a table mounted within said housing for supporting said game piece and further including means for manipulating said table to direct said game piece to randomly strike and deflect from said obstruction members prior to coming to rest on the table and displaying one of said scoring indica.

9. Apparatus as set forth in claim 8 wherein said table comprises a disc mounted within said housing and the manipulating means rotates said disc to centrifugally convey said game piece amongst said obstruction members.

10. Game apparatus comprising:

a) at least one game piece having a plurality of surfaces containing scoring indicia;

b) a multi-walled housing wherein the walls mount to one another to completely enclose and contain said game piece and to define a columnar play space between ones of the plurality of walls where movement of said game piece is confined; and c) a plurality of obstruction members mounted to project from a plurality of said walls into said play space, wherein each obstruction member is shaped to deflect said game piece, wherein none of the obstruction members contact any other obstruction member, and wherein each obstruction member projects without contacting any other of said plurality of walls, to form a plurality of random pathways to said game piece at interstices between the obstruction members and without permitting passage of said game piece between a distal end of any obstruction member and an adjacent wall, whereby as the game piece moves in the play space the game piece randomly deflects from said obstruction members to randomly follow one of the pathways prior to coming to rest on one of said walls to display one of the scoring indicia.

11. Game apparatus comprising:

a) a game piece;

b) a table to support said game piece;

c) a stationary housing having a plurality of walls which mount to one another to completely-enclose said table and game piece and provide a cavity where movement of said game piece is restricted;

d) a plurality of obstruction members, wherein ones of said obstruction members extend from external ones of said walls into a play space above said table; and e) means for rotating said table independent of said housing to centrifugally convey said game piece amongst said obstruction members such that said game piece randomly strikes and deflects from said obstruction members prior to coming to rest on the table to display one of said scoring indicia.

12. Apparatus as set forth in claim 11 wherein said table comprises a disc mounted within said housing and the manipulating means rotates said disc to centrifugally convey said game piece amongst said obstruction members.

13. Apparatus as set forth in claim 11 wherein said game piece includes a plurality of surfaces and each of said surfaces contains a scoring indicia.

14. Apparatus as set forth in claim 13 including a plurality of said game pieces.

15. Apparatus as set forth in claim 11 wherein the table includes a plurality of projections which segment said table into a plurality of game piece support regions, said support regions being assigned predetermined scoring values.

16. Apparatus as set forth in claim 11 wherein said table further includes a plurality of obstruction members.

17. Game apparatus comprising:

a) a game piece;

b) a multi-walled, air filled housing wherein the walls mount to one another to completely enclose and contain said game piece and to define a columnar play space between ones of the plurality of walls where movement of said game piece is restricted; wherein said housing is comprised of first and second open-ended shells having peripheral edges at the open ends that mate to one another; wherein said housing includes means for retaining said first and second shells to one another; wherein first and second opposite end walls of said housing are flat; wherein each of first and second vertical walls, which extend between said first and second end walls, include surfaces adjacent the first and second end walls which bow outward from an intermediate planar region; and wherein the intermediate planar regions of each of said first and second vertical walls are mounted parallel to one another;

c) a plurality of obstruction members mounted to project from ones of said walls into the play space without contacting any other obstruction member and to form a plurality of alternate pathways to said game piece at interstices between the obstruction members; wherein each obstruction member is shaped to deflect said game piece upon contact; and wherein the obstruction members are arranged to randomly deflect the game piece without interrupting movement and to cause the game piece to follow one of the alternate pathways.

* * * * *